US007813688B2

(12) United States Patent
Seol et al.

(10) Patent No.: US 7,813,688 B2
(45) Date of Patent: Oct. 12, 2010

(54) FUSING ROLLER WITH AN ELASTIC LAYER OF LOW HARDNESS AND METHOD OF MANUFACTURING THE SAME, FUSING UNIT EMPLOYING THE FUSING ROLLER, AND IMAGE FORMING APPARATUS EMPLOYING THE FUSING UNIT

(75) Inventors: Dong-jin Seol, Suwon-si (KR); Seung-jun Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 230 days.

(21) Appl. No.: 11/776,078

(22) Filed: Jul. 11, 2007

(65) Prior Publication Data

US 2008/0170895 A1 Jul. 17, 2008

(30) Foreign Application Priority Data

Jan. 15, 2007 (KR) ..... 10-2007-0004351

(51) Int. Cl.
*G03G 15/20* (2006.01)

(52) U.S. Cl. ..... 399/333

(58) Field of Classification Search ..... 399/333, 399/328; 219/216

See application file for complete search history.

(56) References Cited

U.S. PATENT DOCUMENTS 5,781,840 A * 7/1998 Chen et al. ..... 430/124.37
6,148,170 A * 11/2000 McMindes et al. ..... 399/330
6,935,733 B2 8/2005 Fukuda et al.
2005/0031387 A1 2/2005 Yokoi et al.
2007/0298252 A1 * 12/2007 Chen et al. ..... 428/339

FOREIGN PATENT DOCUMENTS

| | | | |
|---|---|---|---|
| EP | 1 724 647 | | 11/2006 |
| JP | 55137558 | A * | 10/1980 |
| JP | 60195573 | A * | 10/1985 |
| JP | 61-250668 | | 11/1986 |
| JP | 10254278 | A * | 9/1998 |
| JP | 2005258029 | | 9/2005 |
| KR | 2001-12101 | | 2/2001 |

OTHER PUBLICATIONS

Computer Translation of JP10-254278A; Sep. 1998.*
European Search Report dated May 20, 2008 issued in EP 07123093.2.

* cited by examiner

*Primary Examiner*—Quana M Grainger
(74) *Attorney, Agent, or Firm*—Stanzione & Kim, LLP

(57) ABSTRACT

A fusing roller which is heated by a heat source, includes: a core member; a first primer which is formed on a circumference of the core member; an elastic layer which is formed on a circumference of the first primer, and adhered on the circumference of the core member by the first primer; and a basic coating layer which is disposed between the core member and the first primer, and chemically combined with the first primer.

32 Claims, 13 Drawing Sheets

FUSING ROLLER WITH AN ELASTIC LAYER OF LOW HARDNESS AND METHOD OF MANUFACTURING THE SAME, FUSING UNIT EMPLOYING THE FUSING ROLLER, AND IMAGE FORMING APPARATUS EMPLOYING THE FUSING UNIT

CROSS-REFERENCE TO RELATED APPLICATIONS

This application claims priority from Korean Patent Application No. 10-2007-0004351, filed on Jan. 15, 2007 in the Korean Intellectual Property Office, the disclosure of which is incorporated herein by reference.

BACKGROUND OF THE INVENTION

1. Field of the Invention

Apparatuses and methods consistent with the present general inventive concept relate to a fusing roller which heats non-fused image transferred onto a printing medium and a method of manufacturing the same, a fusing unit employing the fusing roller and an image forming apparatus employing the fusing unit, and more particularly, to a fusing roller which is provided to prevent wrap jam, to secure heat necessary to fuse during a high-speed printing and a stable durability and a method of manufacturing the same, a fusing unit employing the fusing roller and an image forming apparatus employing the fusing unit.

2. Description of the Related Art

In general, an electrophotographic image forming apparatus scans a beam onto a photosensitive body electrified to a predetermined electric potential to form an electrostatic latent image, and develops the image with a predetermined color toner and transfers and fuses the same onto a printing medium to print an image thereon. The electrophotographic image forming apparatus is provided with a fusing unit along a printing path to fuse the transferred image onto the printing medium.

FIG. 1 is a schematic view illustrating a conventional lamp heating type fusing unit, and FIG. 2 is a schematic sectional view illustrating a layer configuration of a fusing roller in FIG. 1.

Referring to the figures, the conventional fusing unit is provided to fuse a non-fused toner image T formed on a printing medium M. The conventional fusing unit comprises a fusing roller 10 in which a thermal lamp 1 is built therein, a pressing roller 20 which is disposed to face the fusing roller 10 and is elastically biased to press toward the fusing roller 10 by an elastic member 5 to form a fusing nip, and a temperature sensor 7 which senses temperature of a surface of the fusing roller 10.

The fusing roller 10 comprises a first core pipe 11 which is provided of a metal material. A first elastic layer 15 and a first release-layer 19 (FIG. 2) are sequentially formed on the surface layer of the first core member 11 and jointed adhesively all together by primers 13 and 17 (FIG. 2).

Accordingly, the first core pipe 11 is heated by the thermal lamp 1, and the first elastic layer 15 is heated by a thermal conduction of the heated pipe 11 to rise to a predetermined fusing temperature where it is maintained.

The temperature sensor 7 measures temperature of a surface of the first elastic layer 15 in and out of contact with the fusing roller 10. Accordingly, a power supplied for the thermal lamp 1 can be controlled on the basis of the measured temperature value.

Accordingly, if the printing medium M on which the non-fused toner image T is formed is transferred to the fusing unit, the toner image T is heated and pressurized by passing through the fusing nip provided between the fusing roller 10 and the pressing roller 20, to be fused onto the printing medium M, and thus the fusing process is completed.

In the color electrophotographic image forming apparatus employing the fusing unit, a first elastic layer is required to have a thin thickness in order to improve warm-up efficiency in forming the fusing roller. Meanwhile, if the thickness of the first elastic layer is thin, a fusing property may be degraded due to reduction of the width of the fusing nip.

Therefore, a hardness of rubber which forms the first elastic layer must be in a low state in order to reduce a warm-up time, to secure fixedness, and to satisfy a margin for preventing wrap jam.

Meanwhile, as described above, if the hardness of the first elastic layer is low, the first elastic layer may be easily exfoliated from a first core pipe. The exfoliation phenomenon is deepened as the fusing temperature and pressure become high.

The exfoliation phenomenon is mainly caused by a chemical property of a low hardness rubber. This is because the low hardness rubber has a small number of cross-linked points, and accordingly is not easily jointed with material other than a high hardness rubber having a lot of cross-linked points. In particular, if the surface is relatively stabilized and does not have a reaction radical, a chemical reaction necessary for coupling tends to be insufficient or weak.

Also, the exfoliation phenomenon may be progressed to occur at a weak portion by a non-uniform coupling on a coupling surface between an elastic layer of rubber material having relatively high temperature and a high deformation and a metal core pipe.

Accordingly, the first elastic layer is exfoliated from the first core pipe under a fusing circumstance of a high temperature and high pressure, and thus durability of the fusing roller may be degraded.

SUMMARY OF THE INVENTION

The present general inventive concept provides a fusing roller which can allow an elastic layer to have a low hardness and prevent an exfoliation of the elastic layer, and a method of manufacturing the same, and a fusing unit and an image forming apparatus employing the same.

Additional aspects of the present general inventive concept will be set forth in part in the description which follows and, in part, will be obvious from the description, or may be learned by practice of the present general inventive concept.

The foregoing and/or other aspects and utilities of the present general inventive concept can be achieved by providing a fusing roller which is heated by a heat source, comprising: a core member; a first primer which is formed on a circumference of the core member; an elastic layer which is formed on a circumference of the first primer, and adhered on the circumference of the core member by the first primer; and a basic coating layer which is disposed between the core member and the first primer, and chemically combined with the first primer.

The foregoing and/or other aspects and utilities of the present general inventive concept can also be achieved by providing a method of manufacturing a fusing roller comprising a core member and an elastic layer which is formed on a circumference of the core member, the method comprising: forming a basic coating layer by coating a basic substance on the circumference of the core member; chemically combining the basic coating layer with a first primer by spreading a first primer on the basic coating layer; and forming the elastic layer on a circumference of the first primer.

The foregoing and/or other aspects and utilities of the present general inventive concept can also be achieved by providing a fusing unit which is provided on a printing path, and fuses an image transferred on a printing medium, the fusing unit comprising: a fusing roller; a pressing roller which is disposed to face the fusing roller, and cooperates to pressurize the printing medium with the fusing roller; and an elastic member which elastically biases to press the pressing roller so as to form a predetermined fusing nip between the fusing roller and the pressing roller.

The foregoing and/or other aspects and utilities of the present general inventive concept can also be achieved by providing an image forming apparatus, comprising: at least one photosensitive body; at least one light scanning unit which scans a beam onto the photosensitive body and forms an electrostatic latent image; at least one developing unit which develops a toner image with respect to the electrostatic latent image formed on the photosensitive body; a transferring unit which transfers the toner image formed by the developing unit on a printing medium; and a fusing unit which fuses the non-fused toner image transferred on the printing medium.

The foregoing and/or other aspects and utilities of the present general inventive concept can also be achieved by providing a method of manufacturing a fusing roller, the method including preparing a surface of a core member to be chemically combined with a primer to be applied thereon, chemically combining the surface of the core member with a first primer by spreading the first primer on the core member, and forming the elastic layer on a circumference of the first primer.

The preparing of a surface of a core member may include coating a basic substance on the circumference of the core member.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
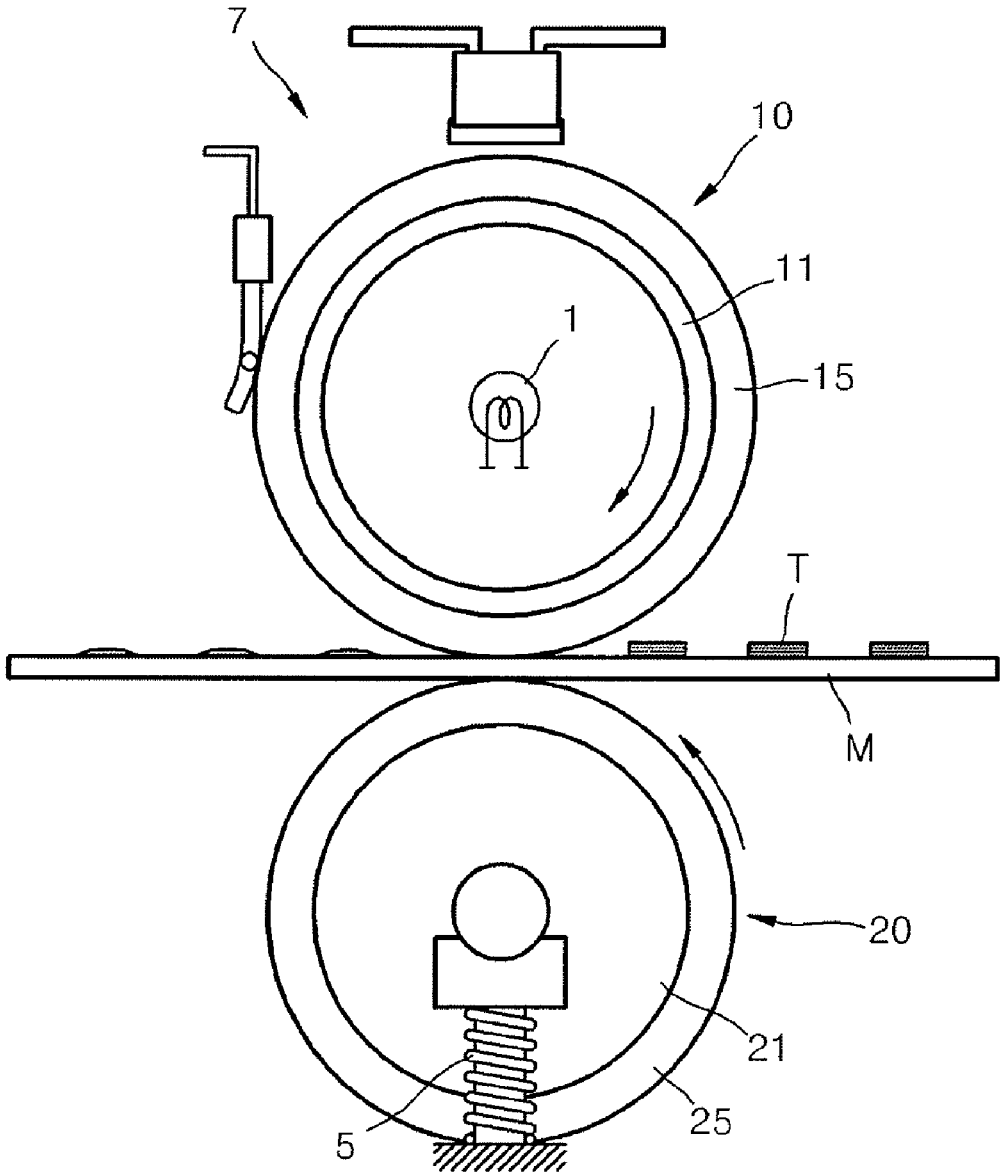
FIG. 1 (RELATED ART)
FIG. 1 is a schematic view illustrating a conventional lamp heating type fusing unit.
Figure 2:
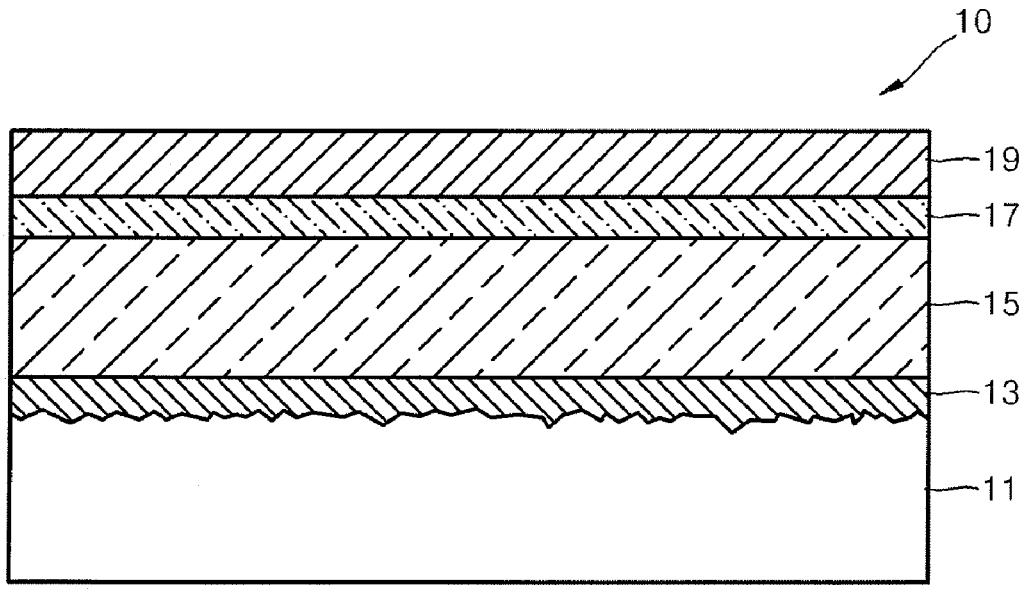
FIG. 2 (RELATED ART)
FIG. 2 is a schematic sectional view illustrating a layer structure of a fusing roller in FIG. 1.

Reference will now be made in detail to the embodiments of the present general inventive concept, examples of which are illustrated in the accompanying drawings, wherein like reference numerals refer to like elements throughout. The embodiments are described below so as to understand more apparently the present general inventive concept by referring to the figures.

Figure 3:
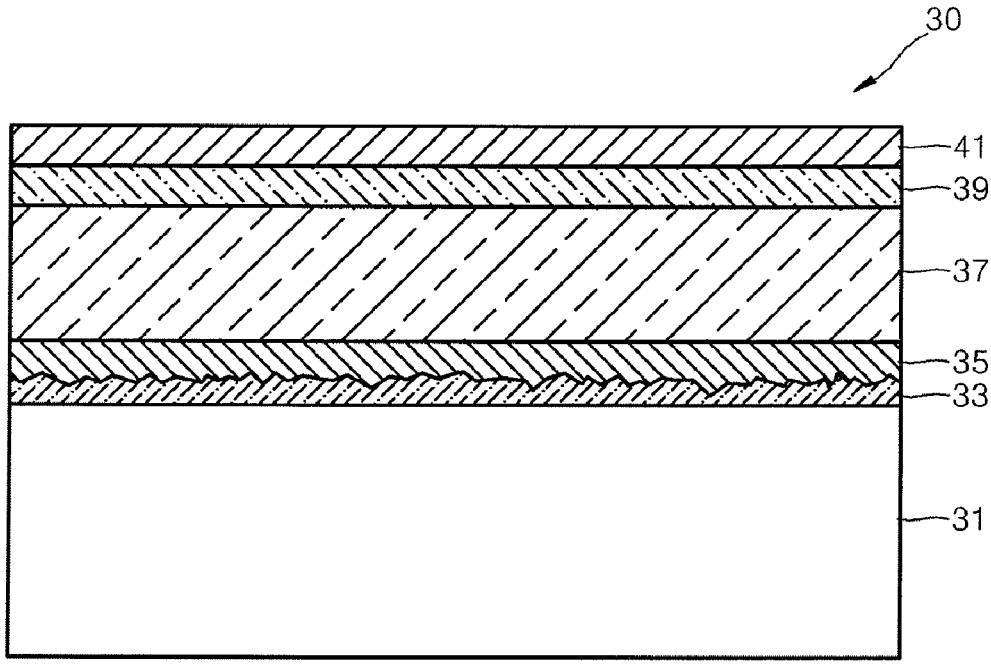
FIG. 3 is a schematic sectional view illustrating a layer structure of a fusing roller according to an exemplary embodiment of the present general inventive concept.

As illustrated in FIG. 3, a fusing roller 30 according to the exemplary embodiment of the present invention is heated by a heat source. The fusing roller 30 comprises a core member 31, a basic coating layer 33, a first primer 35 and an elastic layer 37 which are sequentially formed on a circumference of the core member 31.

The core member 31 is to maintain the shape of the fusing roller 30 according to the present general inventive concept. The core member 31 can be provided of metal, such as aluminum, having a good rigidity and thermal conductivity. Here, the surface of the core member 31 may be processed with sand blast so that the basic coating layer 33 can be coated on the external surface of the core member 31.

The first primer 35 is used to join the elastic layer 37 with the core member 31, and comprises a high polymer.

As described above, the elastic layer 37 is provided of a low hardness rubber so as to reduce a warm-up time, to secure fixedness and to satisfy a margin for preventing wrap jam at the same time. For example, if the hardness value of the elastic layer 37 is set as H, the H satisfies a condition of the following formula 1.

$$2° \leqq H \leqq 10° \qquad \text{[conditional expression 1]}$$

Here, the hardness value H denotes a value according to the standard JIS-A.

Also, the elastic layer 37 may comprise silicon rubber or fluorine rubber in consideration of setting of width of the fusing nip and fusing temperature formed in a space with a pressing roller (refer to 120 in FIG. 10) if the fusing unit, which will be described later, employs the fusing roller 30 according to the present general inventive concept. Here, for example, poly dimethyl silicon rubber, metal vinyl silicon rubber, metal phenyl silicon rubber, fluorine silicon rubber and the like are employed for the silicon rubber.

Meanwhile, as described above, an exfoliating problem of the elastic layer 37 can be solved by further comprising a basic coating layer 33 between the core member 31 and the first primer 35, and chemically combining the basic coating layer 33 with the first primer 35.

The basic coating layer 33 prevents the elastic layer 37 from being exfoliated from the core member 31 by a chemical combination with the first primer 35.

For this purpose, the basic coating layer 33 is formed by basic-coating processing on the external surface of the core member 31, and forms a predetermined functional group. That is, the basic coating layer 33 comprises a hydroxyl group (—OH) or a carboxyl group (—COOH), and dehydrating-reacts with the first primer 35 to be chemically coupled with the first primer 35.

Here, if the hydroxyl group (—OH) is included in forming the basic coating layer 33, the basic coating layer 33 may be provided of hydroxyl group chemicals comprising phosphoric acid manganese [$Mn_5H_2(PO_4)_4.4H_2O/FeHPO_4.2H_2O$], phosphoric acid zinc [$Zn_3(PO_4)_2.4H_2O/FeHPO_4.2H_2O$] and phosphoric acid iron [$FeHPO_4.2H_2O/\gamma Fe_2O_3$].

As described above, the cross-linked point can be increased between the core member 31 and the elastic layer 37 as in the case of the high-hardness elastic layer by chemically coupling the basic coating layer 33 with the first primer 35. Accordingly, the elastic layer 37 can be prevented from being exfoliated, and can be uniformly formed via the first primer 35. Here, a detail of the chemical coupling between the functional group of the basic coating layer 33 and the functional group of the first primer 35 will be described later.

Also, the fusing roller 30 according to the exemplary embodiment of FIG. 3 may further comprise a second primer 39 and a release-layer 41 sequentially formed on the elastic layer 37.

The second primer 39 is disposed between the elastic layer 37 and the release-layer 41 to adhere the release-layer 41 on a circumference of the elastic layer 37. The release-layer 41 prevents a heated medium (not illustrates) from being adhered on the circumference of the elastic layer 37. Accordingly, a printing medium (see M in FIG. 10) is prevented from being adhered to the fusing roller 30 if the fusing roller 30 is employed in the fusing unit of the image forming apparatus, thereby preventing a wrap jam.

Figure 4:
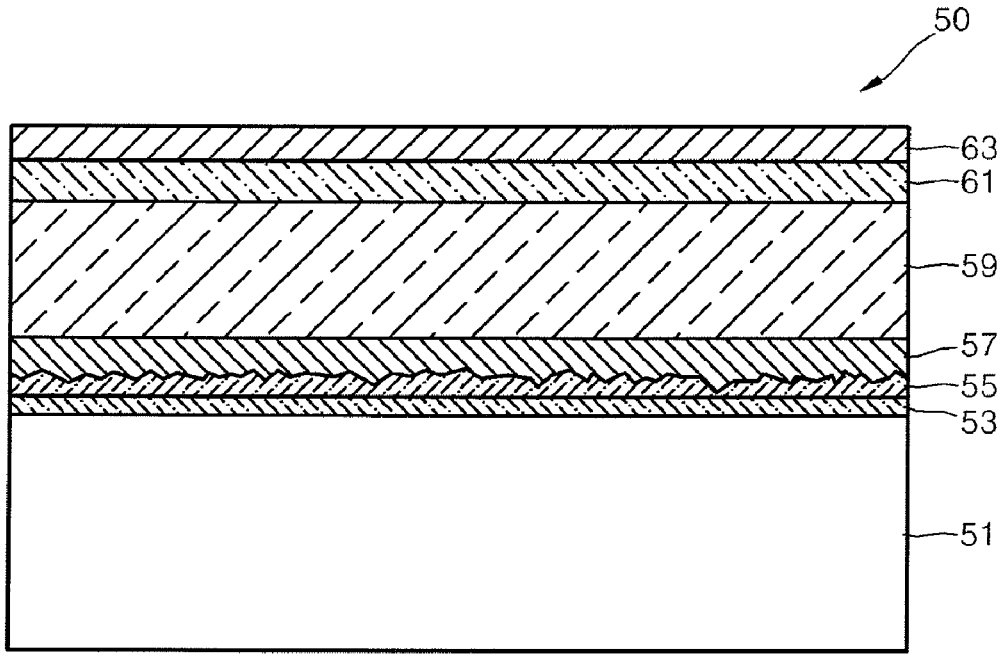
FIG. 4 is a schematic sectional view illustrating a layer structure of a fusing roller according to another exemplary embodiment of the present general inventive concept.

Referring to FIG. 4, a fusing roller 50 according to another exemplary embodiment of the present general inventive concept is heated by a heat source, and comprises sequentially a core member 51, a plating layer 53 formed on the circumference of the core member 51, a basic coating layer 55, a first primer 57 and an elastic layer 59.

In the exemplary embodiment of FIG. 4, the description of each structure of the core member 51, the basic coating layer 55, the first primer 57 and the elastic layer 59 will be omitted so as to avoid a repeated explanation as it practically performs the same function as the structure having the same member name of the fusing roller (see 30 in FIG. 3) according to the exemplary of FIG. 3 embodiment. Meanwhile, the fusing roller 50 according to this exemplary embodiment is distinguished from the fusing roller (see 30 in FIG. 3) according to the previous exemplary embodiment in that it further comprises the plating layer 53 between the core member 51 and the basic coating layer 55.

The plating layer 53 prevents the core member 51 from being corroded through the above-described basic coating processing if the core member 51 is provided of metal having a weak corrosion. Here, the formation of the plating layer 53 can be performed by plating processing such as electroplating, vacuum depositing, vacuum alloying, ion plating, melted plating, cathode sputtering, and vapor plating.

As described above, if the plating layer 53 is formed on the core member 51, the core member 51 can be prevented from being corroded by forming the basic coating layer 55 on the circumference of the core member 51.

Here, the surface of the core member 51 may be processed with sand blast so that the plating layer 53 can be uniformly coated.

Also, the surface of the plating layer 53 may be processed with sand blast so that the basic coating layer 55 can be uniformly coated on the plating layer 53.

Also, the fusing roller 50 according to this exemplary embodiment may further comprise a second primer 61 and a release-layer 63, which are sequentially formed on the elastic layer 59. The description of the structure and the function of the second primer 61 and the release-layer 63 will be omitted as they are the same as the configuration having the same member name according to the previous exemplary embodiment.

Hereinafter, a method of manufacturing the fusing roller according to several exemplary embodiments of the present general inventive concept will be described in detail while referring to FIGS. 5 to 7.

Figure 5:
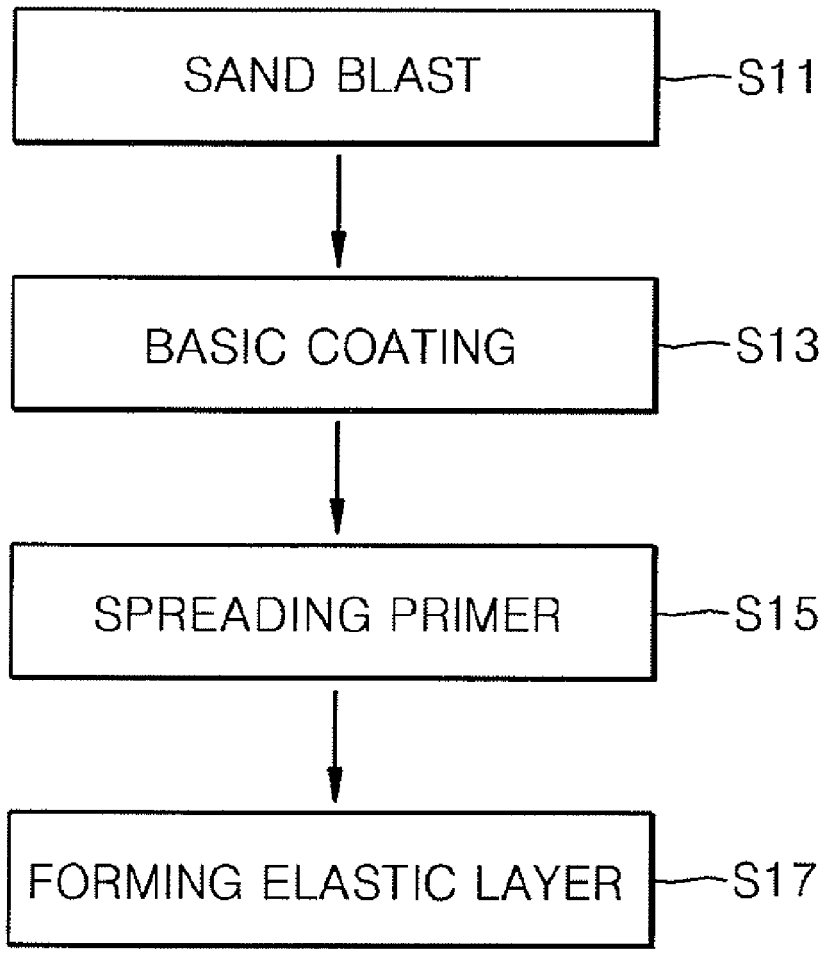
FIG. 5 is a schematic block diagram illustrating a manufacturing process of a fusing roller according to an exemplary embodiment of the present general inventive concept.
Figure 6:
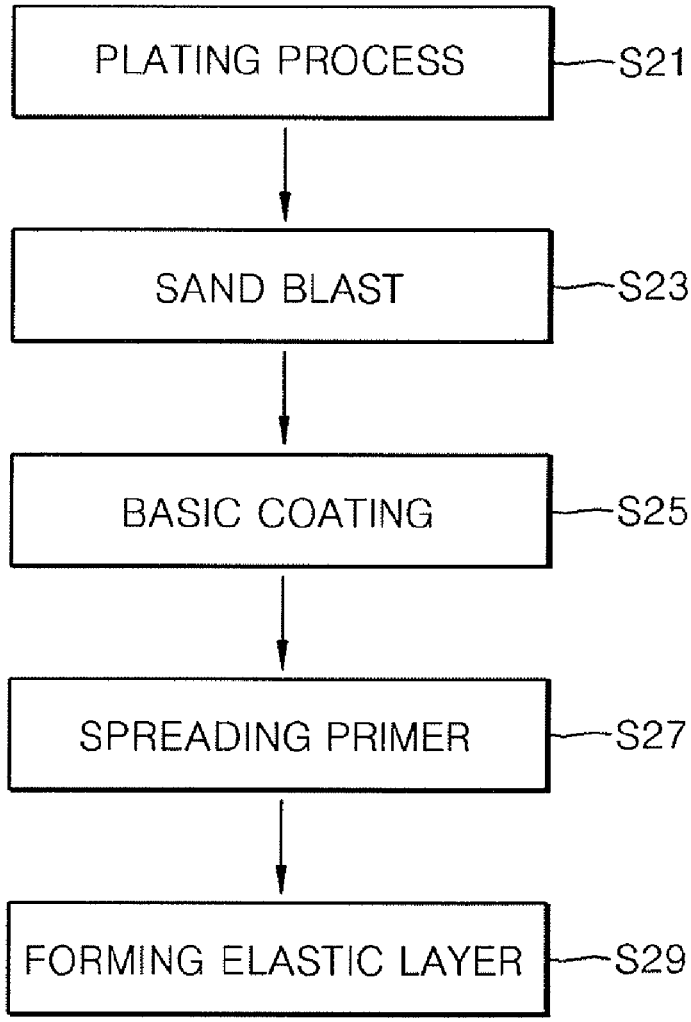
FIG. 6 is a schematic block diagram illustrating a manufacturing process of a fusing roller according to another exemplary embodiment of the present general inventive concept.
Figure 7:
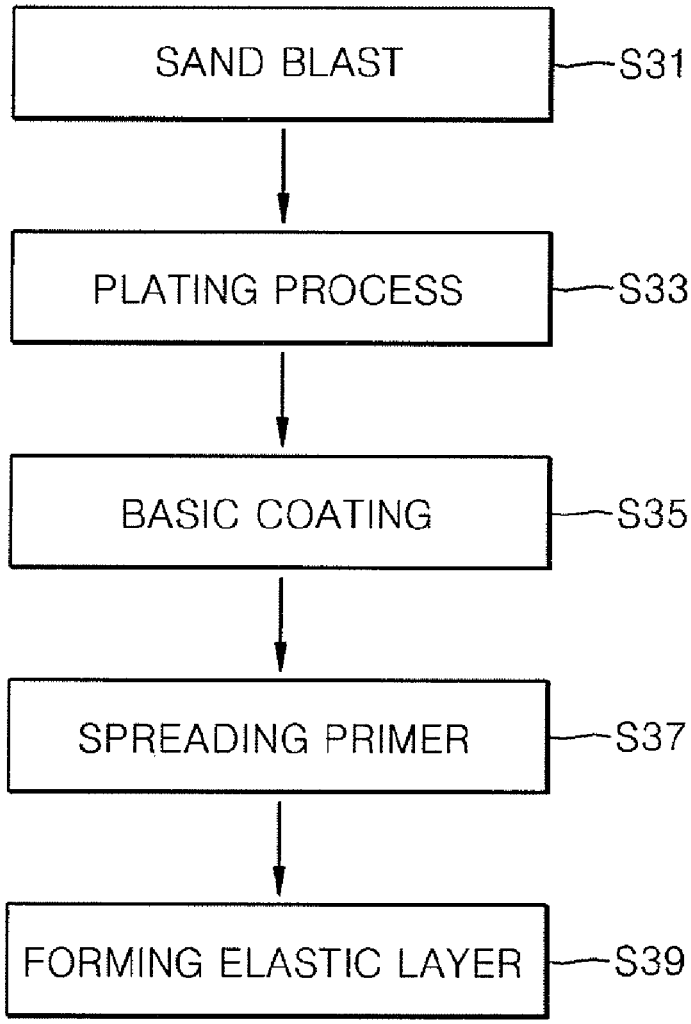
FIG. 7 is a schematic block diagram illustrating a manufacturing process of a fusing roller according to another exemplary embodiment of the present general inventive concept.

FIGS. 5 to 7 are schematic block diagrams illustrating manufacturing processes of the fusing rollers according to the previous exemplary embodiments of FIGS. 3 and 4.

The manufacturing method of the fusing roller according to the exemplary embodiment of FIG. 3 is used for manufacturing the fusing roller having the configuration illustrated in FIG. 3.

Referring to FIGS. 3 and 5, the manufacturing method of the fusing roller according to the exemplary embodiment of FIG. 3 comprises stages carried out sequentially on the circumference of the core member 31, the stages including: a stage S13 on which the basic coating layer 33 is formed, a stage S15 on which the first primer 35 is spread, and a stage S17 on which the elastic layer 37 is formed.

In the stage S13 a basic coating layer is formed by coating a basic substance comprising a hydroxyl group (OH—) or a carboxyl group (COOH—) on the circumference of the core member 31. Here, a stage S11 on which the surface of the core member 31 is processed with sand blast may be further performed before the stage S13 so that the basic coating layer 33 can be uniformly coated on the surface of the core member 31.

In the stage S15 of spreading the first primer 35, the basic coating layer 33 is chemically combined with the first primer 35, and the elastic layer 37 can be prevented from exfoliating even though the elastic layer 37 has a low hardness.

Also, a stage on which the second primer 39 is spread on the elastic layer 37, and a stage on which a release-layer 41 can be formed on an external part of the second primer 39 may be further performed so that a heating object does not adhere on the external surface of the elastic layer 37.

A manufacturing method of the fusing roller according to another exemplary embodiment of the present general inventive concept is used to manufacture the fusing roller having the configuration illustrated in FIG. 4. Referring to FIGS. 4 and 6, the manufacturing method of the fusing roller according to this exemplary embodiment comprises stages carried out sequentially on the circumference of the core member 51, the stages including: a stage S21 on which the plating layer 53 is formed, a stage S25 on which the basic coating layer 55 is formed, a stage S27 on which the first primer 57 is spread, and a stage S29 on which the elastic layer 59 is formed on.

The plating layer 53 is formed to prevent the core member 51 from being corroded by a chemical reaction with the basic coating layer 55. The plating layer 53 is formed on the circumference of the core member 51 through the stage S21. Here, the formation of the plating layer 53 can be performed by a plate processing such as electroplating, vacuum depositing, vacuum alloying, ion plating, melted plating, cathode sputtering, and vapor plating.

At the forming stage S25 the basic coating layer 55 is formed by coating a basic substance comprising a hydroxyl group (OH—) or a carboxyl group (COOH—) on the circumference of the core member 51. Here, a stage S23 on which the surface of the plating layer 53 is processed with sand blast may be further preformed before the stage S25 so that the basic coating layer 55 can be uniformly coated on the surface of the plating layer 53.

The stage S27 of the first primer 57 chemically combines the basic coating layer 55 with the first primer 57, and the elastic layer 59 can be prevented from being exfoliated by chemical combination between the basic substance and the first primer 57 even though the elastic layer 59 is in a low hardness state.

Also, a stage on which the second primer 61 is spreaded on the elastic layer 59, and a stage on which a release-layer 63 can be formed at an external part of the second primer 61 may be further performed so that a heating object is not adhered on the external surface of the elastic layer 59.

A manufacturing method of the fusing roller according to another exemplary embodiment of the present general inventive concept is used to manufacture the fusing roller having the configuration illustrated in FIG. 4. Referring to FIGS. 4 and 7, the manufacturing method of the fusing roller according to this exemplary embodiment comprises stages carried out sequentially on the circumference of the core member 51, the staging including: a stage S33 on which the plating layer 53 is formed, a stage S35 on which the basic coating layer 55 is formed, a stage S37 on which the first primer 57 is spread, and a stage S39 on which the elastic layer 59 is formed.

Also, a stage S31 on which the surface of the plating layer 53 is processed with sand blast may be further performed before the stage S33 so that the basic coating layer 55 can be uniformly coated on the surface of the core member 51. In addition, a stage on which the surface of the plating layer 53 is processed with sand blast may be further performed before the stage S35.

The detailed description of the other processes will be omitted as they are similar to the manufacturing process of the fusing roller according to the previous exemplary embodiment.

Hereinafter, chemical coupling between the basic coating layers 33 and 55 and the first primers 35 and 57 which form the fusing roller according to the above-described exemplary embodiments will be described.

Figure 8A:
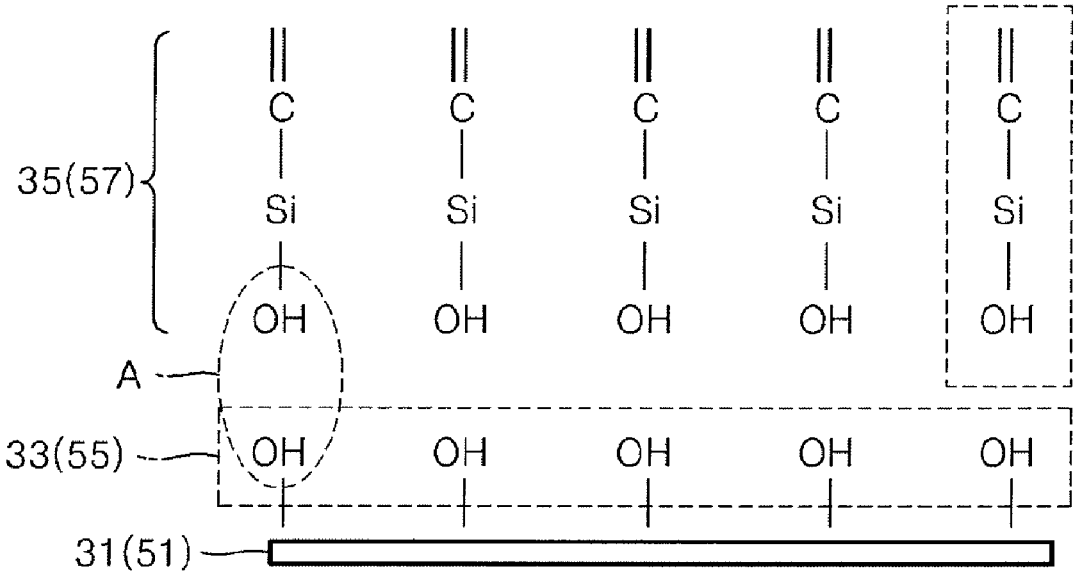
FIGS. 8A and 8B are chemical coupling structural views illustrating a chemical coupling relation between a primer and a basic coating layer of a fusing roller according to an exemplary embodiment of the present general inventive concept.
Figure 8B:
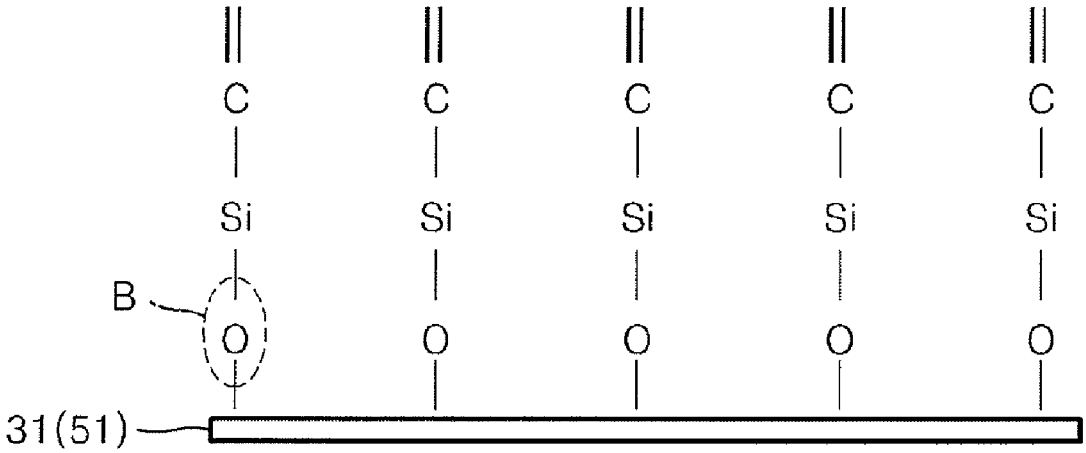

Referring to FIGS. 8A and 8B, the first primers 35 and 57 which are formed of high polymers comprise a hydroxyl group (OH—). Also, the basic coating layers 33 and 55 which are coated on the surface of the first primers 35 and 57 comprise a hydroxyl group (OH—). Accordingly, as Illustrated in an area A, each of the hydroxyl groups of the basic coating layers 33 and 55 and the first primers 35 and 57 forms a functional group.

Hereinafter, the functional group of the basic coating layers 33 and 55 hydrated-reacts with the functional group of the first primers 35 and 57, and $H_2O$ gets out of the group. Also, as illustrated in an area B, the basic coating layers 33 and 55, and the first primers 35 and 57 are chemically combined with each other. By the chemical coupling, the first primers 35 and 57 are adhered to the core members 31 and 51, respectively, and elastic layers 37 and 59 having a low hardness are formed by the adhered first primers 35 and 57, thereby complementing a weak point for coupling.

Figure 9A:
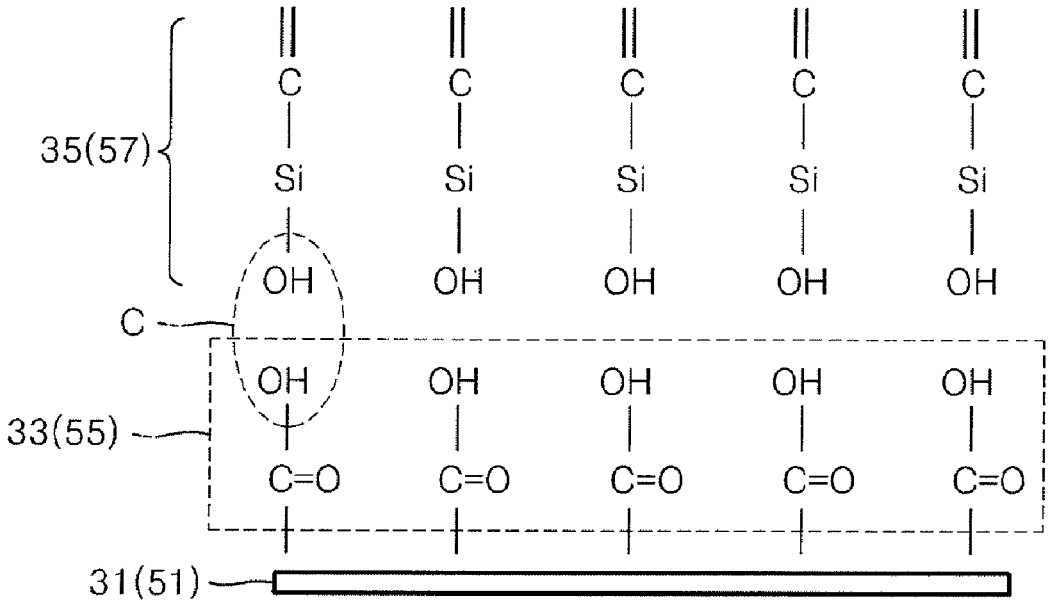
FIGS. 9A and 9B are chemical coupling structural views illustrating a chemical coupling relation between a primer and a basic coating layer of a fusing roller according to another exemplary embodiment of the present general inventive concept.
Figure 9B:
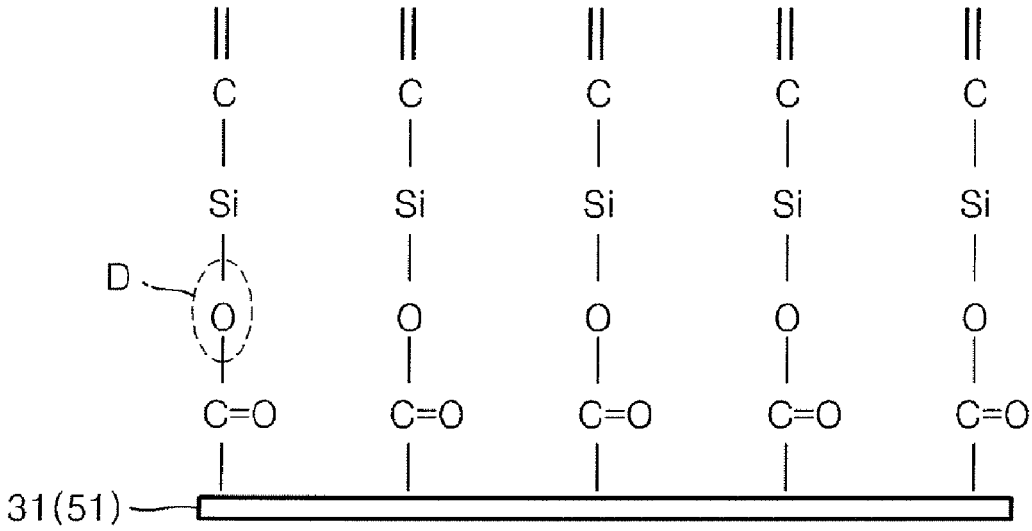

As illustrated in FIGS. 9A and 9B, the first primers 35 and 57 which are formed of high polymers comprise a hydroxyl group (OH—). Meanwhile, the basic coating layers 33 and 55 comprise a carboxyl group (COOH—).

Accordingly, as illustrated in an area C, the carboxyl group of the basic coating layers 33 and 55 and the hydroxyl group of the first primers 35 and 57 form a functional group.

Accordingly, the functional group of the basic coating layers 33 and 55 hydrated-reacts with the functional group of the first primers 35 and 57, and $H_2O$ gets out of the group. Also, as illustrated in an area D, the basic coating layers 33 and 55 and the first primers 35 and 57 are chemically combined with each other. By the chemical coupling, the first primers 35 and 57 are adhered to the core members 31 and 51, respectively, and elastic layers 37 and 59 having a low hardness are formed through the first primers 35 and 57, thereby removing a weak point for coupling.

Figure 10:
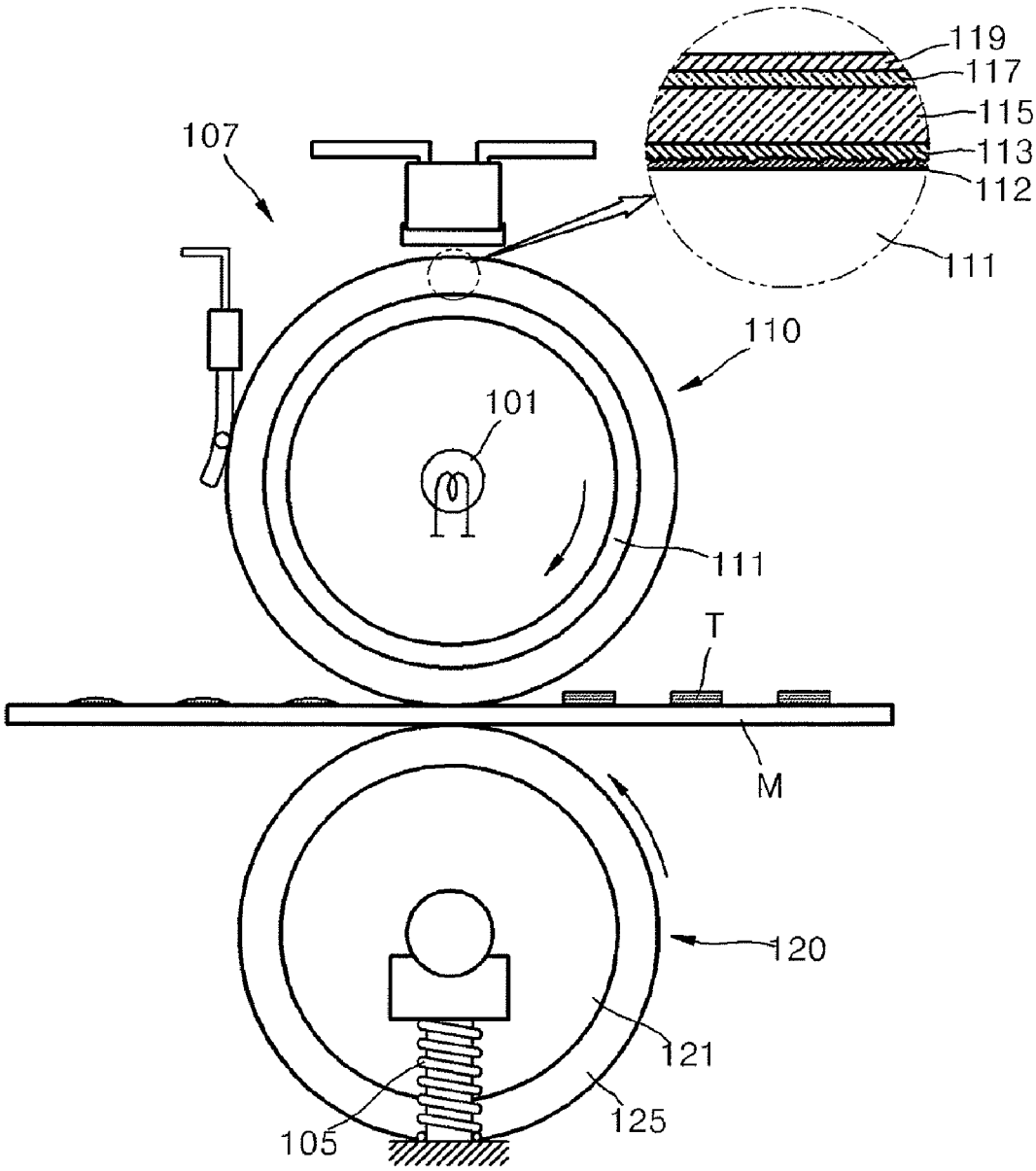
FIG. 10 is a schematic view illustrating a fusing unit according to an exemplary embodiment of the present general inventive concept.

As illustrated in FIG. 10, the fusing unit according to this exemplary embodiment is provided on a printing path of an image forming apparatus to fuse an image T transferred on a printing medium M. The fusing unit comprises a fusing roller in which a thermal lamp 101 is built, a pressing roller 120 which is disposed to face the fusing roller 110 and is elastically biased to press toward the fusing roller 110 by an elastic member 105 to form a fusing nip, and a temperature sensor 107 which senses the surface temperature of the fusing roller 110.

The fusing roller 110 comprises a first core member 111 which is provided of a metal material, a basic coating layer 112, a first primer 113, a first elastic layer 115, a second primer 117 and a first hetero layer 119 which are sequentially formed on the surface of the first core member 111. Therefore, the first core member 111 is heated by the thermal lamp 101, and the first elastic layer 115 is heated by the thermal conduction to rise to a predetermined fusing temperature and be maintained.

Here, the detail description of the fusing roller 110 will be omitted as it has a similar configuration as the fusing roller 110 according to the exemplary embodiments of the present general inventive concept described with reference to FIGS. 3 and 4.

The temperature sensor 107 measures the surface temperature of the first elastic layer 115 in and out of contact with the fusing roller 110. Accordingly, a power supplied for the thermal lamp 101 can be controlled on the basis of the measured surface temperature value measured in the temperature sensor 107.

The pressing roller 120 comprises a second core member 121 which can be provided of metal, a second elastic layer 125 and a second release-layer (not illustrated) which are sequentially provided on the surface of the second core member 121.

Accordingly, if the printing medium M on which a non-fused toner image T is formed is fed to the fusing unit, the toner image T is heated and pressurized through the fusing nip provided between the rotating fusing roller 110 and the pressing roller 120 to be fused onto the printing medium M, and thus the fusion is completed.

Figure 11:
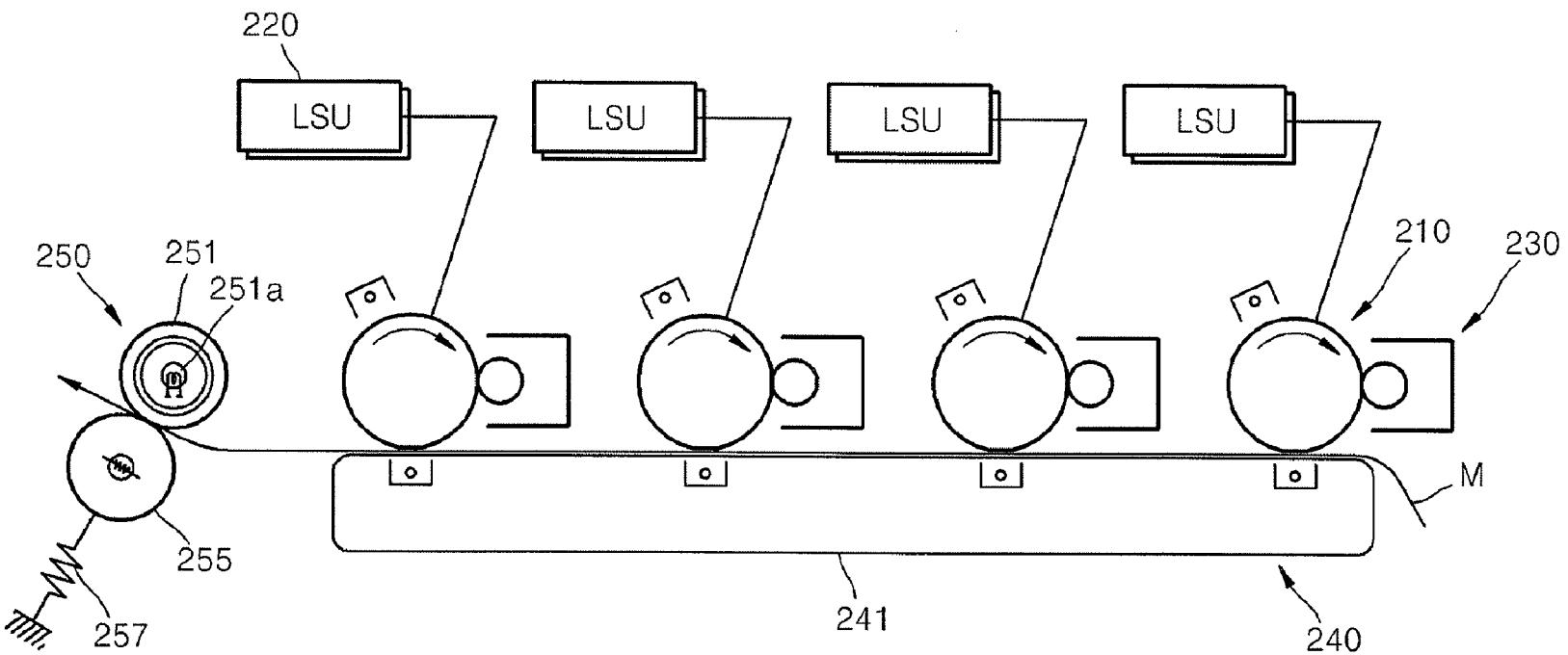
FIG. 11 is a schematic view illustrating an image forming apparatus according to an exemplary embodiment of the present general inventive concept.

As illustrated in FIG. 11, the image forming apparatus according to an exemplary embodiment comprises a plurality of photosensitive bodies 210, a plurality of light scanning units 220 which scan a beam onto each the photosensitive body 210 to form each electrostatic latent image thereon, a plurality of developing unit 230 which develop toner image with respect to the electrostatic latent image formed on each photosensitive body 210, a transferring unit 240 which transfers the toner image formed by each light scanning unit 230 onto a printing medium M, and a fusing unit 250 which fuses the non-fused toner image transferred onto the printing medium M.

Here, FIG. 11 illustrates a tandem-type color image forming apparatus as an example. The photosensitive body 210, the laser scanning unit 220 and the developing unit 230 are provided in plural for each of the colors along with the feeding path of the printing medium M.

The transferring unit 240 is disposed to face the plurality of photosensitive bodies 210. When the printing medium M is passed through the feeding path intervened therebetween, the transferring unit 240 transfers the toner image formed by the light scanning unit 230 on the passed printing medium M. For performing this function, the transferring unit 240 comprises a transferring belt 241 which is disposed to face the plurality of photosensitive bodies 210.

The fusing unit 250 comprises a fusing roller 251 in which a thermal lamp 251*a* is built, a pressing roller 255 which cooperates to pressurize the printing medium M on which the non-fused toner image is formed with the fusing roller 251, and an elastic member 257 which elastically biases to press the pressing roller 255 in a direction of the fusing roller 251. Accordingly, the fusing roller 251 heats its surface by the heat generated in the thermal lamp 251*a*, and fuses the non-fused toner image T transferred onto the printing medium M by pressure of the pressing roller 255. Here, the detail description of the configuration and operating principle of the fusing unit 250 will be omitted as it is similar to that of the fusing unit according to the above-described exemplary embodiments.

As described above, the fusing roller and the fusing unit employing the same according to the various embodiments have effects as follows. The fusing roller and the fusing unit employing the same allow an elastic layer to have a low hardness, thereby reducing a warm-up time, securing a good fixedness, and satisfying a margin for preventing wrap jam. Also, a cross-linked point increases through chemical coupling by dehydrating-reaction between a basic coating layer and a primer, thereby preventing exfoliation of an elastic layer even under a fusing condition in high temperature and pressure. Accordingly, durability of the fusing roller can be prevented from depreciating, and thereby increasing durability of the fusing roller and the fusing unit employing the same.

Also, in the methods of manufacturing the fusing roller, corrosion of a core member caused in forming a basic coating layer on the fusing roller is prevented, and a plating layer and a basic coating layer are uniformly adhered on the surface of the core member through a sand blast processing, thereby improving durability of the fusing roller.

Furthermore, the image forming apparatus employing the fusing unit having the above-described configuration according to the present general inventive concept allow an elastic layer of the fusing roller to have a low hardness, thereby reducing a warm-up time, and preventing a fusing inferiority and wrap jam. Also, durability of fusing unit is improved, thereby enhancing the reliability for the image forming apparatus.

Although a few exemplary embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A fusing roller which is heated by a heat source, comprising:

a core member;

a first primer formed on a circumference of the core member;

an elastic layer formed on a circumference of the first primer, and adhered on the circumference of the core member by the first primer; and a basic coating layer disposed between the core member and the first primer, and chemically combined with the first primer.

2. The fusing roller according to claim 1, wherein the elastic layer satisfies the following conditional expression:

$$2° \leqq H \leqq 10°$$

where, H denotes a hardness value of the elastic layer.

3. The fusing roller according to claim 2, wherein the elastic layer comprises at least one rubber selected from a group consisting of poly dimethyl silicon rubber, metal vinyl silicon rubber, metal phenyl silicon rubber, fluorine silicon rubber and fluorine rubber.

4. The fusing roller according to claim 1, wherein the basic coating layer comprises a hydroxyl group or a carboxyl group.

5. The fusing roller according to claim 4, wherein the basic coating layer is provided of a chemical compound of at least one hydroxyl group selected from a group consisting of phosphoric acid manganese, phosphoric acid zinc and phosphoric acid iron.

6. The fusing roller according to claim 1, further comprising a plating layer provided between the core member and the basic coating layer.

7. The fusing roller according to claim 6, further comprising:

a release-layer provided on a circumference of the elastic layer, and prevents a heating object from being adhered on the circumference of the elastic layer; and a second primer which is disposed between the elastic layer and the release-layer, and joints the release-layer on the circumference of the elastic layer.

8. The fusing roller according to claim 1, further comprising:

a release-layer provided on a circumference of the elastic layer, and prevents a heating object from being adhered on the circumference of the elastic layer; and a second primer disposed between the elastic layer and the release layer and joints the release layer on the circumference of the elastic layer.

9. A method of manufacturing a fusing roller comprising a core member and an elastic layer which is formed on a circumference of the core member, the method comprising:

forming a basic coating layer by coating a basic substance on the circumference of the core member;

chemically combining the basic coating layer with a first primer by spreading a first primer on the basic coating layer; and forming the elastic layer on a circumference of the first primer.

10. The method of manufacturing the fusing roller according to claim 9, further comprising:

forming a plating layer by plating a circumference of the core member.

11. The method of manufacturing the fusing roller according to claim 10, further comprising:

processing a circumference of the plating layer with sand blast.

12. The method of manufacturing the fusing roller according to claim 9, further comprising:

processing the circumference of the plating layer with sand blast.

13. The method of manufacturing the fusing roller according to claim 9, further comprising:

coating the second primer on the elastic layer; and forming a release-layer in an external part of the second primer to prevent a heating object from being adhered to a circumference of the elastic layer.

14. The method of manufacturing the fusing roller according to claim 9, wherein the basic coating layer comprises a hydroxyl group or a carboxyl group.

15. A fusing unit usable along a printing path, and fuses an image transferred on a printing medium, the fusing unit comprising:

a fusing roller comprising a core member, a first primer formed on a circumference of the core member, an elastic layer formed on a circumference of the first primer, and adhered on the circumference of the core member by the first primer, and a basic coating layer disposed between the core member and the first primer, and chemically combined with the first primer;

a pressing roller disposed to face the fusing roller, and cooperates to pressurize the printing medium with the fusing roller; and an elastic member which elastically biases to press the pressing roller to form a predetermined fusing nip between the fusing roller and the pressing roller.

16. The fusing unit according to claim 15, wherein the elastic layer satisfies the following conditional expression:

$$2° \leqq H \leqq 10°$$

where, H denotes a hardness value of the elastic layer.

17. The fusing unit according to claim 16, wherein the elastic layer comprises at least one rubber selected from a group consisting of poly dimethyl silicon rubber, metal vinyl silicon rubber, metal phenyl silicon rubber, fluorine silicon rubber and fluorine rubber.

18. The fusing unit according to claim 15, wherein the basic coating layer comprises a hydroxyl group or a carboxyl group.

19. The fusing unit according to claim 18, wherein the basic coating layer is provided of a chemical compound of at least one hydroxyl group selected from a group consisting of phosphoric acid manganese, phosphoric acid zinc and phosphoric acid iron.

20. The fusing unit according to claim 15, further comprising:

a plating layer disposed between the core member and the basic coating layer, and prevents corrosion of the core member.

21. The fusing unit according to claim 20, further comprising:

a release-layer provided on the circumference of the elastic layer, and prevents a heating object from being adhered on the circumference; and a second primer disposed between the elastic layer and the release layer, and joints he release layer on the circumference of the elastic layer.

22. The fusing unit according to claim 15, wherein the basic coating layer comprises a hydroxyl group or a carboxyl group.

23. An image forming apparatus, comprising:

at least one photosensitive body;

at least one light scanning unit which scans a beam onto the photosensitive body and forms an electrostatic latent image;

at least one developing unit which develops a toner image with respect to the electrostatic latent image formed on the photosensitive body;

a transferring unit which transfers the toner image formed by the developing unit on a printing medium; and a fusing unit which fuses the non-fused toner image transferred on the printing medium, the fusing unit comprising a core member, a first primer formed on a circumference of the core member, an elastic layer formed on a circumference of the first primer, and adhered on the circumference of the core member by the first primer, and a basic coating layer disposed between the core member and the first primer, and chemically combined with the first primer.

24. The image forming apparatus according to claim 23, wherein the elastic layer satisfies the following conditional expression:

$$2° \leqq H \leqq 10°$$

where, H denotes a hardness value of the elastic layer.

25. The image forming apparatus according to claim 24, wherein the elastic layer comprises at least one rubber selected from a group consisting of poly dimethyl silicon rubber, metal vinyl silicon rubber, metal phenyl silicon rubber, fluorine silicon rubber and fluorine rubber.

26. The image forming apparatus according to claim 23, wherein the basic coating layer comprises a hydroxyl group or a carboxyl group.

27. The image forming apparatus according to claim 26, wherein the basic coating layer is provided of a chemical compound of at least one hydroxyl group selected from a group consisting of phosphoric acid manganese, phosphoric acid zinc and phosphoric acid iron.

28. The image forming apparatus according to claim 23, further comprising:

a plating layer disposed between the core member and the basic coating layer, and prevents corrosion of the core member.

29. The image forming apparatus according to claim 28, further comprising:

a release-layer provided on the circumference of the elastic layer, and prevents a heating object from being adhered on the circumference; and a second primer disposed between the elastic layer and the release-layer, and joints the release-layer on the circumference of the elastic layer.

30. The image forming apparatus according to claim 23, comprising a hydroxyl group or a carboxyl group.

31. A method of manufacturing a fusing roller, the method comprising:

preparing a surface of a core member to be chemically combined with a primer to be applied thereon;

chemically combining the surface of the core member with a first primer by spreading the first primer on the core member; and forming the elastic layer on a circumference of the first primer.

32. The method according to claim 31, wherein the preparing a surface of a core member comprises coating a basic substance on the circumference of the core member.

* * * * *